US011725654B2

(12) United States Patent
Maurischat

(10) Patent No.: US 11,725,654 B2
(45) Date of Patent: Aug. 15, 2023

(54) METHOD FOR CONVEYING A FLUID THROUGH A SCREW PUMP, AND SCREW PUMP

(71) Applicant: LEISTRITZ PUMPEN GMBH, Nuremberg (DE)

(72) Inventor: Roland Maurischat, Nuremberg (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 17/541,385

(22) Filed: Dec. 3, 2021

(65) Prior Publication Data

US 2022/0186727 A1 Jun. 16, 2022

(30) Foreign Application Priority Data

Dec. 16, 2020 (DE) ..... 10 2020 133 760.4

(51) Int. Cl.

| | |
|---|---|
| ***F04C 15/00*** | (2006.01) |
| ***F04C 2/16*** | (2006.01) |
| ***F04C 14/28*** | (2006.01) |

(52) U.S. Cl.

CPC ..... *F04C 15/008* (2013.01); *F04C 2/16* (2013.01); *F04C 14/28* (2013.01); *F04C 15/0061* (2013.01); *F04C 2210/24* (2013.01); *F04C 2240/40* (2013.01)

(58) Field of Classification Search

CPC ..... F04C 15/008; F04C 2/16; F04C 14/28; F04C 15/0061; F04C 2210/24; F04C 2240/40

See application file for complete search history.

(56) References Cited

U.S. PATENT DOCUMENTS

| | | | | |
|---|---|---|---|---|
| 2,511,878 A * | 6/1950 | Rathman | ..... | F04C 2/084 418/201.1 |
| 6,457,950 B1 | 10/2002 | Cooper | | |
| 7,096,681 B2 | 8/2006 | Wills | | |
| 9,689,385 B2 | 6/2017 | Rohlfing | | |

(Continued)

FOREIGN PATENT DOCUMENTS

| | | |
|---|---|---|
| CA | 2058325 A1 | 6/1992 |
| CN | 1950613 A | 4/2007 |

(Continued)

OTHER PUBLICATIONS

Russian Patent Office issued an Office Action dated May 25, 2022 regarding parallel Russian Patent Application No. 2021130873; 8 pages.

(Continued)

*Primary Examiner* — Connor J Tremarche

(74) *Attorney, Agent, or Firm* — Lucas & Mercanti, LLP; Klaus P. Stoffel

(57) ABSTRACT

A method for conveying a fluid through a screw pump, wherein at least one drive spindle of the screw pump is driven by an asynchronous motor, wherein, the asynchronous motor is operated at a first nominal frequency, a gas/liquid mixture being conveyed as fluid, a measurable variable depending on a liquid content of the fluid is registered, and after a fulfillment of a frequency-change condition depending on the measurable variable the asynchronous motor is operated at a second nominal frequency, reduced in comparison with the first nominal frequency.

12 Claims, 4 Drawing Sheets

(56) References Cited

U.S. PATENT DOCUMENTS

| | | | | |
|---|---|---|---|---|
| 10,590,930 | B2 | 3/2020 | Brandt | |
| 2012/0251335 | A1* | 10/2012 | Hurst | G01F 1/74 417/1 |
| 2014/0056720 | A1* | 2/2014 | Jackle | F04B 17/03 417/18 |
| 2018/0230997 | A1 | 8/2018 | Dearden | |

FOREIGN PATENT DOCUMENTS

| | | | |
|---|---|---|---|
| CN | 104487715 | B | 4/2018 |
| DE | 3621967 | A1 | 1/1988 |
| DE | 19539656 | A1 | 4/1997 |
| DE | 69129037 | T2 | 7/1998 |
| DE | 102006061971 | A1 | 6/2008 |
| DE | 102012006444 | A1 | 10/2013 |
| DE | 102013102032 | A1 | 9/2014 |
| JP | H8100773 | A | 4/1996 |
| JP | H10281844 | A | 10/1998 |
| JP | 2017025741 | A | 2/2017 |
| JP | 2018501424 | A | 1/2018 |
| RU | 2324075 | C2 | 5/2008 |
| RU | 2433306 | C1 | 11/2011 |

OTHER PUBLICATIONS

European Patent Office issued European Search Report dated May 16, 2022 regarding parallel European Patent Application No. 21204667. 6. 10 pages.

Japanese Patent Office issued an Office Action dated Nov. 15, 2022 regarding parallel Japanese Patent Application No. 2021-189796: 6 pages.

* cited by examiner

METHOD FOR CONVEYING A FLUID THROUGH A SCREW PUMP, AND SCREW PUMP

CROSS-REFERENCE TO RELATED APPLICATIONS

The present application claims priority of DE 10 2020 133 760.4, filed Dec. 16, 2020, the priority of this application is hereby claimed, and this application is incorporated herein by reference.

BACKGROUND OF THE INVENTION

The invention relates to a method for conveying a fluid through a screw pump, wherein at least one drive spindle of the screw pump is driven by an asynchronous motor. In addition, the invention relates to a screw pump.

Screw pumps are employed in many fields in order to convey fluids. In this connection, purely liquid media—for instance, crude oil or petroleum—may be conveyed. Frequently, however, mixtures of gases and liquids—for instance, of petroleum and natural gas—are present which are to be conveyed.

If a gas/liquid mixture with a relatively high gas content is being conveyed in conventional screw pumps, the compression of the gas takes place primarily by virtue of the fact that liquid from pump chambers that are already at a relatively high pressure flows back into preceding pump chambers and compresses the gas therein. A disadvantageous aspect of this is that the fluid is initially conveyed contrary to a relatively steep pressure gradient and subsequently flows back at least partially into a region of lower pressure. This typically results in a power requirement for the pump that is approximately independent of the gas content. Even in the case of high gas contents, the design and drive of the pump are consequently undertaken in just the same way as would also be undertaken for a pure conveying of liquid.

Within the scope of an internal further development of appropriate pumps, it has been recognized that through suitable choice of the pump geometry and rotational speed it can be ensured that screw pumps in multiphase operation in the case of high gas contents of, for instance, 90% or more require a lower drive power—for instance, 25% lower—than for a pure transport of liquid.

However, in many applications in which a multiphase mixture is being conveyed—for instance, in the field of the joint conveying of petroleum and natural gas—plug flows may arise, so that a fluid with almost 100% liquid content has to be conveyed for a short time. However, since the aforementioned further development lowers the requisite drive power exclusively in the case of high gas contents, although a noticeable reduction of the energy costs in such applications results, the asynchronous motor has to be designed in such a way that the screw pump makes a sufficient power available for a pure transport of liquid. Therefore the reduction of the requisite drive power exclusively in the case of the transport of fluids with high gas content is not sufficient is in most applications in order also to be able to design the drive of the screw pump to be of smaller dimensions, and consequently to lower the costs of procurement of the screw pump.

SUMMARY OF THE INVENTION

The object underlying the invention is consequently to reduce the costs or, to be more exact, the technical effort for the provision of a screw pump.

The object is achieved by a method for conveying a fluid through a screw pump, wherein at least one drive spindle of the screw pump is driven by an asynchronous motor, wherein

- the asynchronous motor is operated at a first nominal frequency, a gas/liquid mixture being conveyed as fluid,
- a measurable variable depending on a liquid content of the fluid is registered, and
- after a fulfillment of a frequency-change condition depending on the measurable variable the asynchronous motor is operated at a second nominal frequency, reduced in comparison with the first nominal frequency.

As will be explained more precisely later, a decrease in the requisite drive power for conveying fluids with high gas content in comparison with the requisite drive power for conveying pure liquids can be obtained, particularly at relatively high rotational speeds of the screw pump. In order to obtain sufficiently high rotational speeds in the case of pumps of relatively small size, it is advantageous to operate the asynchronous motor within the so-called field-weakening range, in which a maximum voltage which is utilized for the purpose of supplying current to the windings of the asynchronous motor is not sufficient, by reason of the inductance of the coils and by reason of the frequency being utilized, in order to obtain maximum currents and consequently maximum field strengths in the asynchronous motor. In the method according to the invention this is exploited, by the nominal frequency being lowered upon fulfillment of the frequency-change condition, so that no field weakening or at least a slighter field weakening results and consequently a higher torque can be made available at the same power. The asynchronous motor can consequently be dimensioned in such a way that at the first nominal frequency it makes a sufficiently high torque available in order to convey a fluid with high gas content of, for instance, at least 90% or with a corresponding liquid content of at most 10%. If it is established on the basis of the measurable variable that the liquid content of the fluid is too high, the nominal frequency can be lowered by reason of the fulfillment of the frequency-change condition, by virtue of which a sufficiently high torque can be made available in order also to convey a fluid with a higher liquid content—for instance, a pure liquid. The asynchronous motor and/or the power supply thereof can consequently be designed to be smaller for substantially the same conveying capacity than would be possible without the lowering, according to the invention, of the nominal frequency.

The respective nominal frequency can be made available to a motor control unit or to a frequency converter which supplies current to the asynchronous motor. Depending on the number of pole pairs of the asynchronous motor, the nominal frequency can predetermine the nominal rotational speed of the asynchronous motor. In order, despite the slippage arising in asynchronous motors, actually to attain the nominal rotational speed, the frequency of the alternating current supplied to the asynchronous motor may lie above the nominal frequency, for instance by reason of a rotational-speed feedback or by reason of a predetermined offset. Alternatively, the nominal frequency can also be used directly as frequency of the alternating current supplied to the asynchronous motor, by virtue of which the actually attained rotational speed of the asynchronous motor is somewhat less, by reason of the slippage, than the nominal rotational speed.

In comparison with an alternative method for conveying a fluid, in which, irrespective of the measurable variable or of a liquid content, an operation would take place in principle at the lower second nominal frequency, several advantages are obtained by the method according to the invention. On the one hand, by utilization of the first nominal frequency so long as the frequency-change condition has not been fulfilled, a higher rotational speed of the asynchronous motor, and consequently also of the drive spindle, results in comparison with an operation at the second nominal frequency, and consequently also a higher conveying capacity of the screw pump with otherwise identical design. This is particularly advantageous if the frequency-change condition has been fulfilled only for a fraction of the operating-time, since in this case by virtue of the method according to the invention approximately the same conveyed quantity is obtained as in the case of an uninterrupted utilization of the first nominal frequency and in the case of an appropriately adapted design of the asynchronous motor. For instance, in applications in which plugs of liquid are conveyed only seldom or for brief periods and otherwise a high gas content is present, the method according to the invention obtains almost the same conveying capacity as is obtained by an asynchronous motor of appropriately larger design that is always operated at the first nominal frequency.

As already explained, the utilization of relatively high rotational speed enables a particularly distinct reduction of the requisite drive power in the case of a conveying of a fluid with high gas content in comparison with the conveying of pure liquids. A lasting reduction of the nominal frequency being utilized, and consequently of the rotational speed, would consequently be disadvantageous with respect to the requisite power if fluids with very low liquid content are being conveyed over a greater part of the operating-time.

In the method according to the invention, a reduction of the nominal frequency in comparison with the first nominal frequency can take place during the operation of the screw pump, disregarding starting-up and slowing-down phases, in particular exclusively upon or after fulfillment of the frequency-change condition. The registering of the measurable variable and the checking of the frequency-change condition are preferentially carried out repeatedly, in particular periodically. In particular, also after the change-over to the second nominal frequency or after fulfillment of the frequency-change condition the measurable variable can continue to be monitored, and a further frequency-change condition can be evaluated, upon or after the fulfillment of which a change back to the first nominal frequency takes place.

Expressed differently, a control device in a first operating mode can operate the asynchronous motor at the first nominal frequency, and in a second operating mode at the second nominal frequency, in which connection changing over between the operating modes take place in a manner depending on the measurable variable—that is to say, in particular, upon fulfillment of the frequency-change condition or of the further frequency-change conditions.

The alternating current that is utilized for operating the asynchronous motor may be, in particular, a rotary current or, to be more exact, a three-phase alternating current with a phase difference of, in particular, 120° between the phases. The various poles of the asynchronous motor are in this case supplied with current by the different phases of the multiphase alternating current.

The measurable variable may relate to a torque applied by the asynchronous machine, or to a current intensity of an alternating current supplied to the asynchronous machine, or to a rotational speed of the asynchronous machine. In the case of a higher liquid content in the fluid being conveyed, a greater braking torque acts contrary to the rotation of the drive spindle and consequently of the asynchronous motor. This leads initially to a retarding of the drive spindle and consequently of the asynchronous motor, which can be detected by monitoring of the rotational speed.

At the same time, this reduction in rotational speed leads to a greater slippage of the asynchronous machine. Since asynchronous machines are typically operated above the tipping-point, such an increase in slippage leads to an increase in the torque of the asynchronous machine and consequently also to a higher current intensity of the alternating current, in particular to a higher active current. The applied torque can, for instance, be registered via a torque sensor. The current intensity or the intensity of an active current can be registered by a current sensor. In this connection, in particular the fact can be exploited that frequency converters—that is to say, for example, voltage rectifiers or power converters—frequently already make available an item of information relating to the current intensity—for instance, a voltage proportional to the active current—at a separate output, by virtue of which the measurable variable can be registered, for example by sampling such an output.

Additionally or alternatively to the indirect registering, elucidated above, of the liquid content via measurable variables depending thereon, which relate to parameters of the asynchronous machine, at least one parameter of the fluid can also be registered and evaluated directly as the measurable variable, for instance an electrical conductivity, a thermal conductivity, a temperature conductivity or a density of the fluid being conveyed.

Approaches for registering appropriate variables of the fluid are known in principle in the state of the art and can be utilized in the method according to the invention in order to ascertain the liquid content, or evaluated as measurable variable within the scope of the frequency-change condition.

The change-over from the first nominal frequency to the second nominal frequency can take place continuously or in several stages over a time-interval after fulfillment of the frequency-change condition. Additionally or alternatively, the change-over from the first to the second nominal frequency can be undertaken by a control loop which regulates the measurable variable to a predetermined value. By a continuous or at least multi-stage change of the nominal frequency, sudden changes of torque are avoided that may lead to severe mechanical loadings of components of the screw pump. For instance, the nominal frequency can be predetermined by digital signal processing, for instance by a microcontroller which upon fulfillment of the frequency-change condition changes the nominal frequency pseudo-continuously in ramp-like manner.

Customary controllers—for instance, integral controllers or proportional-integral controllers—can be utilized as control loop for controlling the nominal frequency as manipulated variable. If the corresponding control loop is configured in such a way that the first nominal frequency cannot be exceeded—that is to say, the control saturates at the first nominal frequency—the fulfillment of the frequency-change condition corresponds to a state of the controller in which the first nominal frequency is fallen short of and consequently the control behavior has not been saturated. The utilization of a control loop makes it possible, in particular, to adjust a suitable nominal frequency, depending on the actual liquid content or on the effect thereof with respect to the requisite applied torque for maintaining a rotational speed.

The first nominal frequency may be at least 10% or at least 20% greater than the cutoff frequency of the asynchronous machine, at which for given maximum operating voltage the field-weakening range begins. Additionally or alternatively, the first nominal frequency may be at most 30% or at most 40% greater than the cutoff frequency. The first nominal frequency is utilized, in particular, in regular operation of the screw pump. As explained in the introduction, for conveying fluids with low liquid content and consequently with high gas content it may, in particular, be advantageous to utilize relatively high rotational speeds and consequently to operate the asynchronous machine within the field-weakening range—that is to say, above the cutoff frequency which is also designated as the type point. The torque attained is, however, approximately proportional to the square of the quotient of cutoff frequency and nominal frequency, so that in the case of too great exceeding of the cutoff frequency by the first nominal frequency very low torques would result. Therefore the limits stated above for the first nominal frequency have proved to be advantageous.

Additionally or alternatively, the second nominal frequency may be greater than or equal to the cutoff frequency. This choice of the second nominal frequency is advantageous, since in the event of a lowering of the nominal frequency below the cutoff frequency the voltages supplied to the asynchronous motor should be reduced, in order to avoid excessive currents and consequently potential damage to the asynchronous motor. However, below the cutoff frequency this typically results in a constant torque, by virtue of which a further lowering of the nominal frequency below the cutoff frequency would not bring any further advantages and, at the same time, would reduce the conveying capacity of the screw pump.

The cutoff frequency or the type point may correspond to the frequency of the electrical grid of 50 Hz or 60 Hz, so that, for instance, in the case of two pole pairs in the course of grid operation a synchronous speed of 1500 rpm or 1800 rpm, respectively, would result. The operating-point or the first nominal frequency can then be chosen, for instance as 70 Hz, so that in the course of normal operation—that is to say, with liquid content that is not too high—a synchronous speed of 2100 rpm results.

In the method according to the invention, use can be made of a screw pump which exhibits a housing which forms at least one fluid inlet and one fluid outlet and in which the at least one drive spindle and at least one revolving spindle, rotationally coupled with said drive spindle, of the screw pump are received which in each rotational position of the drive spindle jointly delimit with the housing several pump chambers, the drive spindle being rotated in a drive direction by the asynchronous machine, as a result of which a respective one of the pump chambers, initially open to the respective fluid inlet, is sealed, the resulting sealed pump chamber is moved axially toward the fluid outlet and is opened there toward the fluid outlet when an opening rotation angle is attained, the drive spindle being driven, at least prior to fulfillment of the frequency-change condition, in such a manner that in the case of a liquid content lying below a limiting value for given pump geometry of the screw pump the pressure in the respective pump chamber, prior to and/or upon the opening rotation angle being attained, has been increased by at most 20% or by at most 10% of a differential pressure between the suction pressure and the pressure in the region of the fluid outlet in comparison with the suction pressure of the screw pump that obtains in the region of the respective fluid inlet. This may hold, for example, as far as a limiting value for the liquid content of 1% or 3% or 5% or 10% or 15% or also as far as a limiting value lying between the stated values.

It has been recognized that by suitable adaptation of the pump geometry and/or of the rotational speed of the pump a reverse flow of fluid through remaining gaps between the pump chambers can be reduced to such an extent that the predominant portion of the rise in pressure generated by the screw pump takes place only after the opening of the respective pump chamber toward the fluid outlet. Given sufficient rotational speed and suitable pump geometry, in this connection it can be at least approximately assumed that by reason of its inertia the liquid already located in the region of the fluid outlet does not substantially flow into the opening pump chamber but instead may be regarded approximately as a rigid wall, against which the gas/liquid mixture is compressed. So long as the fluid in the opening chamber has a high gas content, a similarly good degree of effectiveness is consequently obtained as with gas compressors that convey gas against a rigid wall of the housing. In contrast to these gas compressors, however, fluids with a very high liquid content, or pure liquids, can also be conveyed.

Prior to the opening rotation angle being attained, the respective pump chamber has been sealed equally relative to the fluid inlet and relative to the adjacent pump chamber in the direction of the fluid inlet and toward the fluid outlet, disregarding deviations due to tolerance. An exchange of fluid in both directions is consequently possible substantially only via the radial and axial gaps of the pump. The opening of the pump chamber toward the fluid outlet when the opening rotation angle is attained results from the fact that the thread, forming the pump chamber, of the respective spindle, or the wall delimited the respective thread toward the fluid outlet, terminates at a certain angular position that depends on the rotation angle of the spindle. This has the result that, starting from a certain limiting angle, a gap in the circumferential direction between this wall and another spindle results which delimits the pump chamber. By virtue of this gap in the circumferential direction, the pump chamber has been opened toward the fluid outlet. The opening rotation angle can consequently be defined as that angle from which, in addition to the axial and radial gaps, a gap in the circumferential direction results. Alternatively, the opening rotation angle could be defined via the flow cross section enabling an exchange of fluid between pump chamber and fluid outlet. If this flow cross section has been enlarged by 50% or 100% or 200% in comparison with the sealed pump chamber, the attaining of this limit can be defined as the opening rotation angle being attained.

The screw pump being used may be single-flow or double-flow—that is to say, it may exhibit one or two fluid inlets situated opposite one another in the axial direction. The screw pump may exhibit two, three or more spindles. Individual spindles may, for instance, be double-threaded. Individual or all spindles may, however, also be single-threaded or triple-threaded, or may also exhibit more threads.

The screw profiles of the respective drive spindle and revolving spindle may have been chosen in such a manner that the mean value of the number of pump chambers per drive spindle and revolving spindle, which have been sealed both in relation to the fluid inlet and in relation to the fluid outlet, over a rotation angle of the drive spindle of 360° is at most 1.5. If, for instance, precisely one drive spindle and precisely one revolving spindle are being used, on average at most three pump chambers may have been completely closed. The mean value can, for instance, be ascertained by integration of the number of closed chambers for a respective rotation angle of the drive spindle over an angle of 360° and by subsequent division of the result by 360°. At constant rotational speed, this corresponds to an integration of the number of simultaneously closed pump chambers over a period of rotation of the drive spindle and to a division by the period of rotation.

Whereas in the case of screw pumps for conveying liquid a utilization of relatively many axially consecutive pump chambers is typically desired, within the scope of the invention it has been recognized that by utilization of relatively few maximally simultaneously closed chambers a greater volume for the individual pump chambers results, with reduced length of the screw profile. The same amount of liquid flowing back through pump gaps consequently leads to a smaller relative change in the volume remaining for the gas content, as a result of which a slighter compression of gas and consequently a slighter increase in pressure results prior to the opening of the pump chamber toward the fluid outlet.

The pump geometry of the screw pump being used and the nominal rotational speed at the first nominal frequency may have been chosen in such a way that the circumferential speed along the outside diameter of the profile of the drive spindle or of at least one of the drive spindles and/or of the revolving spindles or of at least one of the revolving spindles is at least 15 m/s. This may hold, in particular, for all drive spindles and revolving spindles. The circumferential speed can be calculated as the product of the outside diameter of the profile, the nominal rotational speed and pi. The nominal rotational speed may be proportional to the nominal frequency, the proportionality factor having been predetermined by the number of pole pairs of the asynchronous machine. Consequently the stated condition can be attained, in particular, in the case of utilization of high rotational speeds and large outside diameters of the profile. By this means, the contribution of liquid flowing back through gaps in respect of the compression of gas can be reduced, and by this means a higher degree of effectiveness in the case of high gas contents can be attained.

Additionally or alternatively, the pump geometry and the nominal rotational speed at the first nominal frequency may have been chosen in such a way that the axial speed of the respective pump chamber in the course of the axial motion toward the fluid outlet is at least 4 m/s. The axial speed depends both on the pitch of the thread or threads of the respective spindle and on the rotational speed. Expressed differently, high axial speeds can be attained by high rotational speeds and/or high pitches or relatively long pump chambers. All these factors lead to a diminution of the influence of liquid flowing back on the pressure in the pump chamber, and consequently to the gain in efficiency that has been explained.

In addition to the method according to the invention, the invention relates to a screw pump for conveying a fluid, which exhibits a housing, in which at least one drive spindle and at least one revolving spindle, rotationally coupled with said drive spindle, of the screw pump are received, an asynchronous motor for driving the drive spindle, and a control device for supplying current to the asynchronous motor, the control device having been set up to carry out the method according to the invention. In particular, in a first operating state the control device operates the asynchronous motor at the first nominal frequency, and in a second operating state at the second nominal frequency. Via internal or external sensors, which were already elucidated above, the control device can register the measurable variable and, depending on the measurable variable, can be operated in the first or second operating mode. In particular, upon or after fulfillment of the frequency-change condition depending on the measurable variable, a change-over to the second operating mode can take place.

The screw pump according to the invention can be developed further with the features elucidated with respect to the method according to the invention, with the advantages stated there, and conversely.

In particular, the housing may form at least one fluid inlet and one fluid outlet, the drive spindle and the revolving spindle in each rotational position of the drive spindle jointly delimiting with the housing several pump chambers, the asynchronous machine having been set up to rotate the drive spindle in a drive direction, as a result of which a respective one of the pump chambers, initially open to the respective fluid inlet, is sealed, the resulting sealed pump chamber is moved axially toward the fluid inlet and is opened there toward the fluid outlet when an opening rotation angle is attained, the screw profiles of the respective drive spindle and revolving spindle having been chosen in such a manner that the mean value of the number of pump chambers per drive spindle and revolving spindle, which have been sealed both in relation to the fluid inlet and in relation to the fluid outlet, in the case of a rotation angle of the drive spindle of 360° is at most 1.5.

In the screw pump according to the invention, on the one hand the inside diameter of the screw profile of the drive spindle or of at least one of the drive spindles and/or of the revolving spindles or of at least one of the revolving spindles may be less than 0.7 times the outside diameter of the respective screw profile, and/or, on the other hand, the mean circumferential gap between the outer edge of the screw profile of the drive spindle or of at least one of the drive spindles and/or of the revolving spindle or of at least one of the revolving spindles and the housing may be less than the 0.002 times the outside diameter of the respective screw profile. By virtue of a relatively large difference between inside diameter and outside diameter, a large pump-chamber volume can be obtained, as a result of which the same amount of liquid flowing back leads to a slighter rise in pressure in the pump chamber, and consequently lower powers are required in the case of high gas contents in the fluid. Relatively narrow gaps may, additionally or alternatively, limit the amount of fluid flowing back and consequently may likewise contribute to the high efficiency in the case of the transport of fluid with high gas content. In particular, the mean value of the width of the circumferential gap along the length of the circumferential gap may be regarded as the mean circumferential gap. Additionally, an averaging over one rotation in respect of the drive spindle of 360° may take place, in order to take variations in the circumferential gap with the rotation of the spindle into consideration.

Further advantages and particulars of the present invention arise out of the exemplary embodiment described in the following and also from the associated drawings.

DETAILED DESCRIPTION OF THE INVENTION

Figure 1:
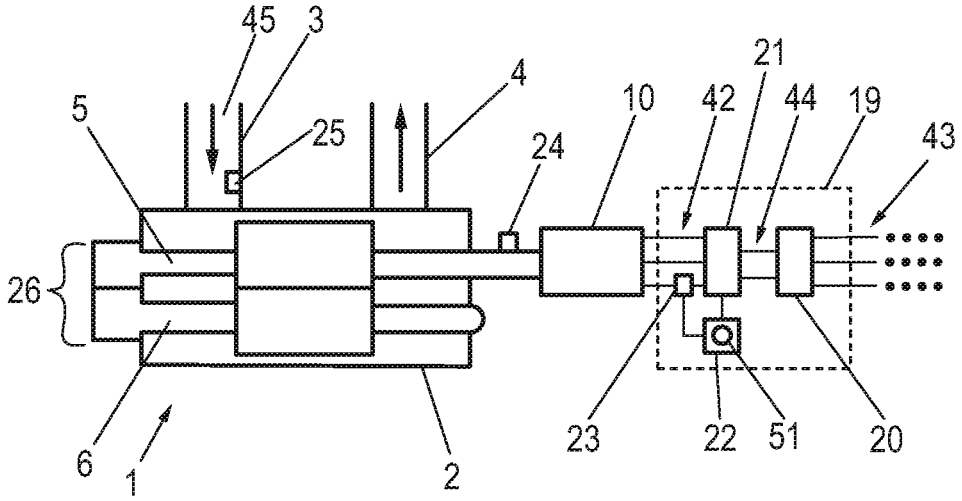
FIG. 1 an exemplary embodiment of a screw pump according to the invention.

FIG. 1 shows schematically a screw pump 1 for conveying a fluid 45 from a fluid inlet 3 to a fluid outlet 4. For the purpose of conveying the fluid 45, a drive spindle 5, driven by the asynchronous motor 10, and a revolving spindle 6, coupled with said drive spindle via a gear mechanism 26, are arranged in the housing 2 of the screw pump 1. For reasons of clarity, a relatively simply configured screw pump 1 has been represented which is single-flow—that is to say, it exhibits only one fluid inlet 3—and in which only one revolving spindle 6 is utilized. The following explanatory remarks can, however, also be applied to multi-flow screw pumps or to screw pumps with more than two spindles, for instance with several revolving spindles or even with several drive spindles.

Figure 2:
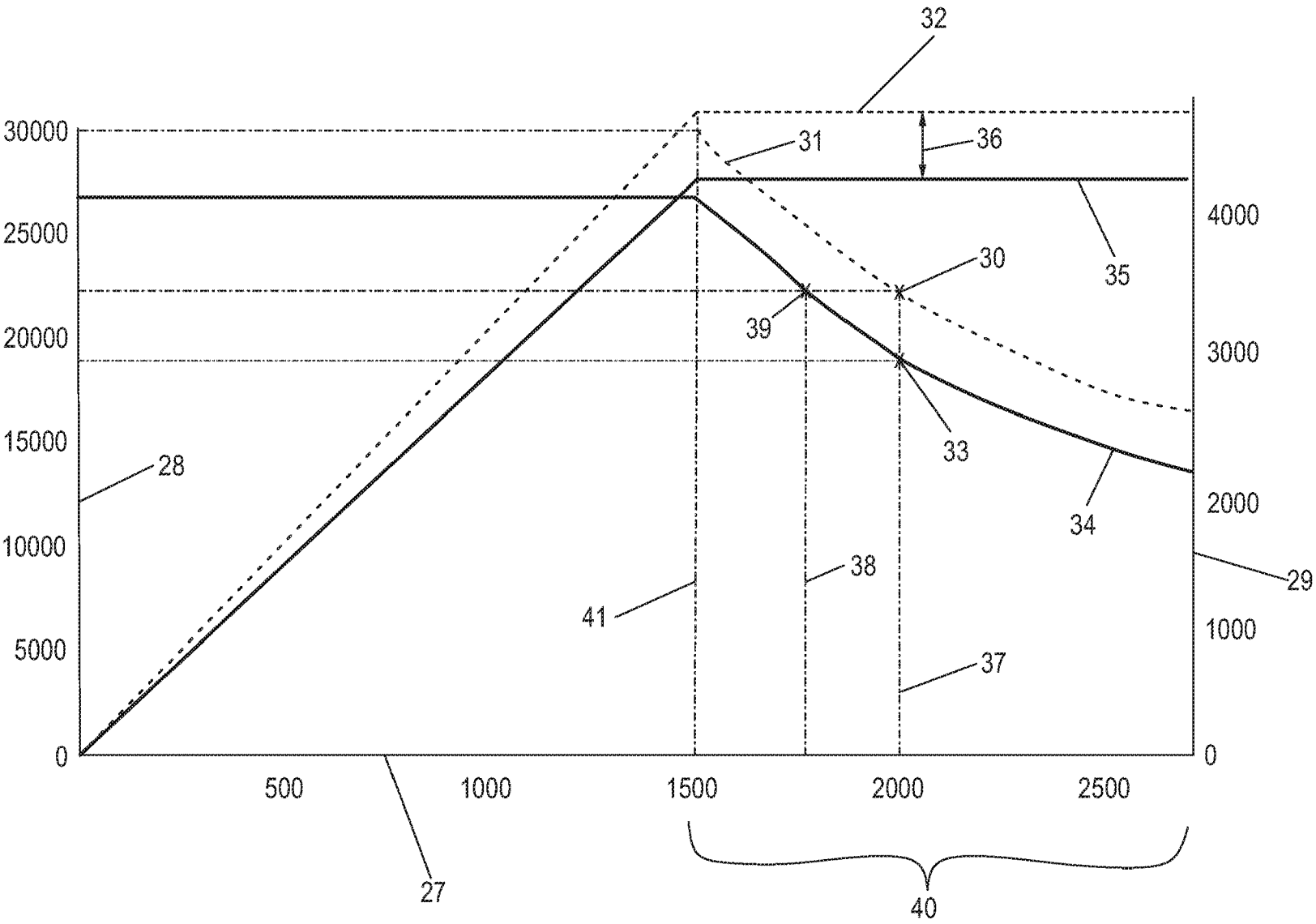
FIG. 2 nominal-frequency-dependent powers and torques for two asynchronous motors, FIG. 3 a flowchart of an exemplary embodiment of the method according to the invention, and FIGS. 4 and 5 detail views of the screw pump shown in FIG. 1.

In customary screw pumps, as already explained in the general part of the description, at least approximately the same torque and consequently also the same power of the asynchronous motor 10 is required for the transport of liquids and gases. The relationship between the torque 31 or the power 32 and the rotational speed for such a customary design of a screw pump is represented in FIG. 2. Therein the X-axis shows the rotational speed in revolutions per minute (rpm), the left Y-axis 28 shows the torque in Newton meters (Nm), and the right Y-axis 29 shows the power in kilowatts (kW).

Within the scope of the further development of appropriate pumps, it has been established that through suitable choice of the pump geometry and rotational speed of the screw pump 1, as will be elucidated later with reference to FIGS. 4 and 5, it can be ensured that in the course of conveying a fluid 45 with high gas content, and consequently with low liquid content, distinctly lower torques are required. For the purpose of conveying a fluid 45 with high gas content, consequently an asynchronous motor 10 of smaller dimensions can be utilized. Also for this asynchronous motor 10 of smaller dimensions, in FIG. 2 the relationship between the rotational speed plotted on the X-axis 27 and the attained torque 34 or the requisite power 35 has been plotted. The rotational speeds plotted in FIG. 2 are each nominal rotational speeds. In addition, in FIG. 2 the nominal rotational speed attained at a respective nominal frequency 37, 38 have been indicated. If, for instance, an asynchronous machine 10 with two pole pairs is being utilized, a first nominal frequency 37 of 70 Hz corresponds to a nominal rotational speed of 2100 rpm.

Now if the screw pump 1 is designed, for instance, for a nominal rotational speed of 2100 rpm and consequently for a corresponding conveyed quantity, and if in this case it is assumed that fluid with high gas content is being transported, then a requisite torque 33 results instead of the requisite torque 30 that would be required for a transport of liquid. Correspondingly, a lower power of the asynchronous machine 10 is also required, in which connection power differences 36 of up to 25% of the power 32 in the case of pure transport of liquid can be attained, depending upon geometry, rotational speed and liquid content.

In the case of the transport of multiphase mixtures, typically a homogeneous mixture cannot be assumed, so the screw pump 1 has to have been designed in such a manner that it is able to transport, at least temporarily, a fluid 45 with a liquid content of up to 100%. In the simplest case, it would be possible to design the asynchronous machine 10 in such a way that at the first nominal frequency 37 being utilized it is able to make a sufficiently high torque 30 available in order also to be able to convey pure liquids. The possibility of conveying a fluid 45 with high gas content with lower power would in this case lower the energy demand and the consequently the operating costs of the screw pump 1, but the technical effort and the procurement costs would remain unchanged, since the asynchronous motor 10 still has to be designed with the same dimensions as for a screw pump that serves for the pure transport of liquid.

Figure 3:
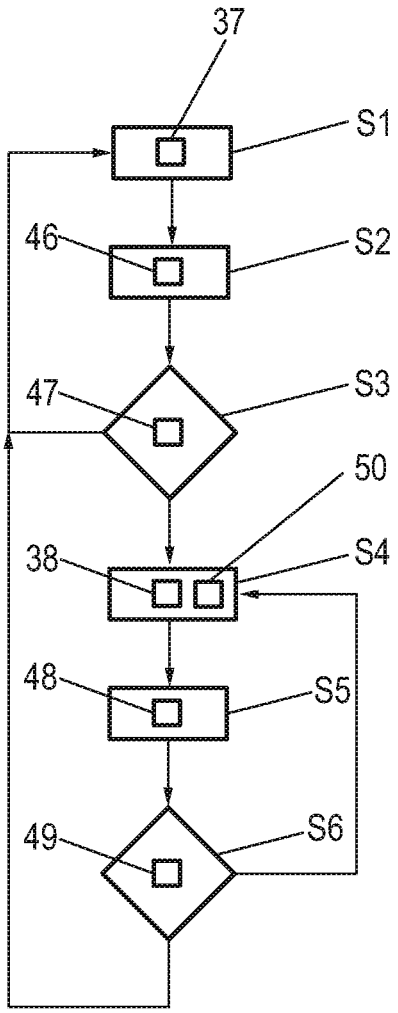

In order also to enable a utilization of an asynchronous motor 10 of smaller dimensions, instead a control device 19 for making the alternating current 42 available for the asynchronous machine 10 is utilized in the screw pump 1, which implements the control method elucidated in the following with reference to FIG. 3.

In step S1, the asynchronous motor 10 is initially operated at a first nominal frequency 37. In this connection, within the scope of the elucidation of the method it will be assumed that initially a gas/liquid mixture with relatively high gas content is being conveyed, so that the torque 33 attained suffices for maintenance of the desired rotational speed.

For the purpose of making the alternating voltage 42 available, for instance an alternating current 43 made available, in particular a rotary current, can initially be rectified by a rectifier 20, in order to make a direct current 44 available which is subsequently converted by an inverter 21 into the alternating current 42, in particular likewise into a rotary current. The inverter 21 may, for instance with the aid of a pulse-width modulation, make an alternating voltage 42 available over a further frequency range of nominal frequencies, and may also vary the voltage amplitude. The procedure in step S1 consequently corresponds to the customary procedure for making alternating current available for an asynchronous motor as soon as a nominal frequency deviating from the grid voltage is desired.

In step S2, a measurable variable 46 that depends on a liquid content of the fluid is registered by a measuring and control element 22. If the liquid content of the fluid 45 rises, this leads to a stronger braking torque on the drive spindle and revolving spindle 5, 6 and consequently on the asynchronous machine 10, as a result of which the rotational speed of the asynchronous machine 10 is reduced. This leads, in turn, to a greater slippage and consequently, at least so long as the tipping-point of the asynchronous machine has not yet been reached, to a higher torque made available by the asynchronous machine 10 and to higher current intensities of the alternating current supplied to the asynchronous machine 10.

A simple possibility for registering a suitable measurable variable is consequently a current sensor 23 which measures a current intensity of the alternating current 42. Said sensor has been represented in FIG. 1 as a separate component, for the purpose of clear representation. In many cases, however, the inverter 21, or generally the frequency converter, which makes the alternating current 42 available may already make available an output signal, in particular a voltage, that is proportional to the current intensity, so that the measurable variable can be registered, for instance by analog-to-digital conversion of this voltage.

Alternatively, by way of measurable variable a rotational speed or a torque could, for instance, also be registered via a sensor 24 arranged in the region of the drive shaft, or a measured value could be registered of a fluid sensor 25 which, for instance, measures an electrical conductivity or a temperature conductivity of the fluid 45.

In step S3, a frequency-change condition 47 is evaluated that depends on the measurable variable 46. The frequency-change condition may, for instance, have been fulfilled if the measurable variable exceeds or falls short of a predetermined limiting value. For instance, the frequency-change condition 47 may have been fulfilled if a torque applied by the asynchronous machine or a current intensity of the alternating current supplied to the asynchronous machine exceeds a limiting value, or if an actual rotational speed of the asynchronous machine falls short of a limiting value. If the frequency-change condition 47 has not been fulfilled, the method can be repeated from step S1, in which case, in particular, the registering of the measurable variable and the checking of the frequency-change condition can be repeated periodically.

After fulfillment of the frequency-change condition 47, on the other hand, in step S4 the asynchronous motor 10 is operated at a second nominal frequency 38, reduced in comparison with the first nominal frequency 37. The change of the nominal frequency may take place over a time-interval 50, in order to avoid sudden changes of torque. As represented in FIG. 2, by utilization of the lower, second nominal frequency 38 a torque 39 can be obtained which, in the example shown, corresponds to the torque 30 that would be required at the originally utilized rotational speed of 2100 rpm for a pure transport of fluid. In this connection it will be assumed in simplifying manner that the torque required for maintaining the rotational speed is independent of the rotational speed. In screw pumps, in the case of rotational speeds that are not too low a lower torque is typically also required for maintaining lower rotational speeds, so that the second nominal frequency 38 could also be chosen to be slightly higher than is represented in FIG. 2.

The described increase in torque, which meets the demand, is possible, since the first and second nominal frequencies 37, 38 lie within the field-weakening range 40 of the asynchronous machine 10—that is to say, within a range in which, by reason of a limited maximum operating voltage which can be made available by the control device 19 or is permitted to be supplied to the asynchronous machine 10, the maximum currents and consequently the maximum field strengths are no longer attained in the coils of the asynchronous machine 10. For the purpose of attaining high efficiencies for a transport of fluids with high gas content, it is advantageous to utilize relatively high rotational speeds of the drive spindle and revolving spindle and consequently of the asynchronous machine 10. In order simultaneously to obtain a pump of small size, it is typically advantageous in any case to utilize, in the normal operation of a screw pump, nominal frequencies within the field-weakening range 40—that is to say, above the cutoff frequency 41 of the asynchronous machine 10. In the example shown, for the purpose of clearer accentuation of the described effect a first nominal frequency 37 is utilized that lies about 40% above the cutoff frequency 41. In real implementations of the described procedure, typically first nominal frequencies 37 are expedient that lie 20-30% above the cutoff frequency 41, depending upon the concrete application.

The operation of the asynchronous machine 10 with alternating current 42 at the second nominal frequency 38 and consequently at lower rotational speed is typically intended to take place only temporarily, for instance while a plug of liquid is being conveyed. Therefore in step S5 a measurable variable 48 is again registered that depends on the liquid content of the fluid. In this connection, the same variables can be registered that were already elucidated with respect to measurable variable 46.

In step S6, a further frequency-change condition 49 is evaluated, upon the fulfillment of which a change-over back to the first nominal frequency 37 and consequently a continuation of the method in step S1 takes place. In the case of non-fulfillment of the further frequency-change condition, on the other hand, the method is repeated from step S4.

The described method can also be modified, by, for instance, instead of the aforementioned limiting-value comparison within the scope of the frequency-change condition, a control loop 51 as part of the measuring and control element 22 being utilized which attempts to regulate the measurable variable 46 to a predetermined value, the nominal frequency 37, 38 serving as manipulated variable. In this connection, this manipulated variable can be limited in such a manner that the first nominal frequency cannot be exceeded, for instance by a saturation element being provided. The non-fulfillment of the frequency-change condition corresponds in this case to the saturation of the control loop 51. So long as the saturation range of the control is not departed from, the first nominal frequency is consequently output as manipulated variable.

Figure 4:
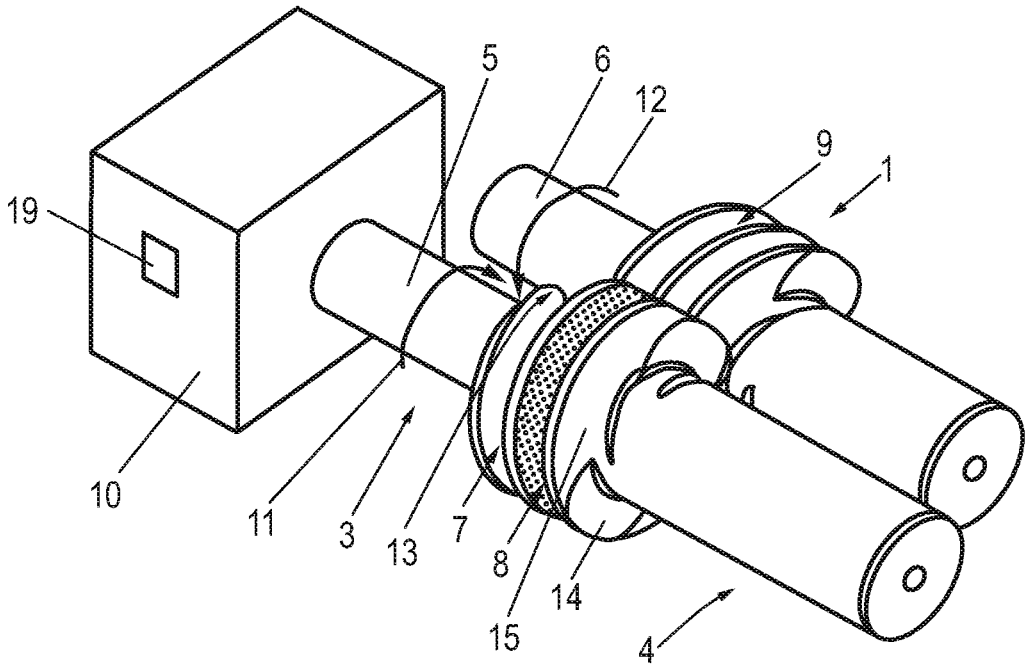
Figure 5:
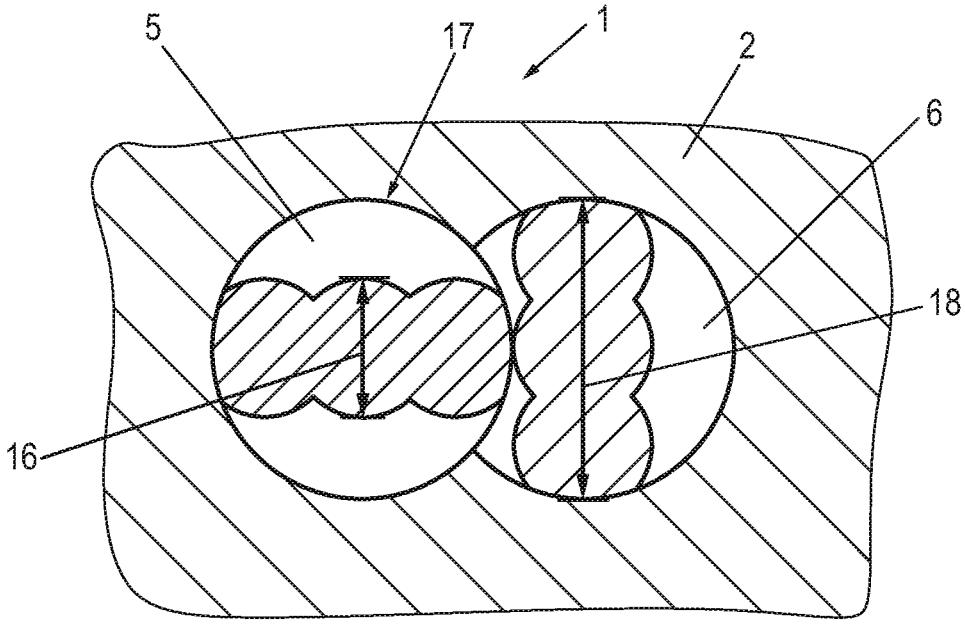

FIGS. 4 and 5 show various detail views of a screw pump which in the course of a conveying of a fluid that is a gas/liquid mixture with low liquid content requires distinctly lower power, for instance 25% less power, than in the case of a transport of a liquid. In this connection, FIG. 4 shows schematically a perspective view of the drive spindle 5 and of the revolving spindle 6 of the screw pump 1, wherein for reasons of clarity the housing has not been represented. FIG. 4 clarifies, in particular, the shape of the screw profiles of the drive spindle 5 and of the revolving spindle 6, as well as the intermeshing thereof.

FIG. 5 shows a transverse section in which, in particular, the interaction can be discerned of the drive spindle 5 and of the revolving spindle 6 with the housing 2, in order to form several separate pump chambers 7, 8, 9 which, in turn, have been labeled in FIG. 4, since they extend beyond the sectional plane shown in FIG. 2.

As already discussed with reference to FIG. 1, the revolving spindle 6 is rotationally coupled with the drive spindle 5 by a coupling device 26, a 1:1 gear ratio being assumed in the example. Consequently, in the course of a drive of the drive shaft 5 by the asynchronous motor 10 in the drive direction 11 the revolving spindle 6 is rotated with reversed direction of rotation 12 and with identical rotational speed. The rotational speed is predetermined by the choice, elucidated above, of the nominal frequency 37, 38 by the control device 19.

By virtue of the intermeshing of the screw profiles of the drive spindle 5 and of the revolving spindle 6, the fluid located in the housing 2 is received in several pump chambers 7, 8, 9 separated from one another. The separating or sealing of the pump chambers 7, 8, 9 is not completely tight, by reason of the radial gap 17 between housing 2 and drive spindle 5 or revolving spindle 6 and by reason of remaining axial gaps between the intermeshing screw profiles, but rather permits a certain exchange of fluid between the pump chambers 7, 8, 9, which may also be regarded as leakage.

In the rotational position of the drive spindle 5 and of the revolving spindle 6 shown in FIG. 4, pump chamber 7 is open toward the fluid inlet 3, since the free end 13 of the wall 15 of the screw thread of the drive spindle 5 in FIG. 1 is directed upward, by virtue of which a gap remains in the circumferential direction between this free end 13 and the revolving spindle 6, through which the fluid is able to flow between pump chamber 7 and the fluid inlet 3. Correspondingly, pump chamber 8, indicated in FIG. 4 by dotting of its external surface, is open to the fluid outlet 4, since the free end 14 of the wall 15 delimiting said chamber is, in turn, by reason of the rotational position, spaced from the revolving spindle 6 and consequently forms a radial gap through which fluid is able to flow. Pump chamber 9 has been sealed both in relation to the fluid inlet 3 and in relation to the fluid outlet 4.

In the course of a drive of the drive spindle 5 in the drive direction 11, the free end 13 of the wall 15 is initially moved toward the revolving coil 6, and consequently the initially open pump chamber 7 is sealed. A further rotation then leads to the displacement of the sealed pump chamber toward the fluid outlet 4. When a certain opening rotation angle is attained, the pump chamber is then opened toward the fluid outlet 4, in which connection upon a rotation by 90° after the opening rotation angle is attained the arrangement results as is represented in FIG. 1 for pump chamber 8, in which a gap already results in the circumferential direction with a certain width between the free end 14 and the revolving spindle 6.

It has been recognized that the power consumption in the course of a conveying of gas/liquid mixtures with high gas content can be reduced considerably if it is ensured that a compression of gas in the course of the conveying does not take place primarily by virtue of the fact that fluid from the fluid outlet or from pump chambers situated downstream flows back into closed pump chambers and compresses the gas therein, but rather the compression of the gas and consequently also the increase in pressure in the pump chamber 7, 8, 9 takes place substantially only after the opening of the respective pump chamber toward the fluid outlet 4. In the example shown, this is obtained, on the one hand, by the choice of a suitable pump geometry and, on the other hand, by utilization of a sufficiently high rotational speed. By this means, it can be ensured that the pressure in the respective pump chamber 7, 8, 9 prior to or upon the opening rotation angle being attained has been increased in comparison with the suction pressure of the screw pump 1 that obtains in the region of the fluid inlet 3 only by a few percent of the differential pressure between the suction pressure and the pressure in the region of the fluid outlet 4. For instance, the pressure in the pump chamber upon opening may be at most 10% or at most 20% of the differential pressure above the suction pressure.

The described behavior could, in principle, be obtained solely by choice of a sufficiently high rotational speed also with customary pump geometries, in which case the requisite high rotational speeds may, under certain circumstances, lead to high loadings or high wear of the pump. Therefore the screw pump 1 utilizes a special pump geometry, in the case of which the described behavior can be attained already at relatively low rotational speeds—for instance, already at 1000 rpm or 1800 rpm. In particular, instead of the customary utilization in screw pumps of a plurality of consecutive pump chambers in the axial direction, relatively few pump chambers or revolutions of the screw threads of the drive spindle 5 and of the revolving spindle 6 are utilized. In the rotational position shown in FIG. 4, only precisely one pump chamber 9 has been sealed both in relation to the fluid inlet 3 and in relation to the fluid outlet 4. Depending on the concrete geometrical configuration of the free ends 13, 14 of the wall 15, in this connection at most one or at most two simultaneously sealed pump chambers may result, irrespective of the state of rotation of the drive spindle 5 and of the revolving spindle 6 in the example shown.

By virtue of the utilization of relatively few consecutive pump chambers in the axial direction, a relatively large volume of the individual pump chambers is already obtained, as a result of which the same amount of a liquid flowing back through gaps into the respective pump chamber has a smaller influence on the pressure in the pump chamber. For the purpose of obtaining a large volume of the pump chambers 7 to 9, in addition it is advantageous that the inside diameter 16 of the screw profile of the drive spindle and revolving spindle 5, 6, as can be clearly discerned in FIG. 5 in particular, is distinctly smaller—for example, approximately smaller by a factor of two—than the outside diameter 18 of the respective spindle.

By utilization of a sufficiently narrow radial gap 17 between the housing 2 and the respective outside diameter 18 of the drive spindle 5 or of the revolving spindle 6, in addition the amount of the liquid flowing back into the respective pump chamber 7, 8, 9 can be reduced further. For instance, the radial gap 25 may be narrower than two thousandths of the outside diameter 18.

As explained, the pump geometry of the screw pump 1 and a sufficiently high rotational speed interact, in order to obtain the effects elucidated above. In this connection, for given pump geometry the rotational speed should be chosen in such a way that the axial speed of the motion of the respective pump chambers 7, 8, 9 toward the fluid outlet 4 is at least 4 m/s, and/or that the circumferential speed along the outer profile 18 of the drive spindle 5 or of the revolving spindle 6 is at least 15 m/s.

While specific embodiments of the invention have been shown and described in detail to illustrate the inventive principles, it will be understood that the invention may be embodied otherwise without departing from such principles.

I claim:

1. A method for conveying a fluid through a screw pump, wherein at least one drive spindle of the screw pump is driven by an asynchronous motor, wherein the asynchronous motor is operated at a first nominal frequency, a gas/liquid mixture being conveyed as fluid, a measurable variable depending on a liquid content of the fluid is registered, and after a fulfillment of a frequency-change condition depending on the measurable variable, the asynchronous motor is operated at a second nominal frequency, reduced in comparison with the first nominal frequency, wherein the first nominal frequency is greater by at least 10% or by at least 20% than a cutoff frequency of the asynchronous motor, at which for given maximum operating voltage the field-weakening range begins.

2. The method according to claim 1, wherein the measurable variable relates to a torque applied by the asynchronous machine, or to a current intensity of an alternating current supplied to the asynchronous motor, or to a rotational speed of the asynchronous motor.

3. The method according to claim 1, wherein a change-over from the first nominal frequency to the second nominal frequency takes place continuously or in several stages over a time-interval after fulfillment of the frequency-change condition, and/or the change-over from the first to the second nominal frequency is undertaken by a control loop which regulates the measurable variable to a predetermined value.

4. The method according to claim 1, wherein the first nominal frequency is greater by at most 30% or by at most 40% than the cutoff frequency, and/or the second nominal frequency is greater than or equal to the cutoff frequency.

5. A screw pump for conveying a fluid, which comprises a housing, in which at least one drive spindle and at least one revolving spindle, rotationally coupled with said at least one drive spindle, of the screw pump are received, an asynchronous motor for driving the drive spindle, and a control device for supplying current to the asynchronous motor, wherein the control device has been set up to carry out the method according to claim 1.

6. The screw pump according to claim 5, wherein the housing forms at least one fluid inlet and one fluid outlet, wherein the drive spindle and the revolving spindle in each rotational position of the drive spindle jointly delimit with the housing several pump chambers, wherein the asynchronous motor has been set up to rotate the drive spindle in a drive direction, as a result of which a respective one of the pump chambers, initially open to the respective fluid inlet, is sealed, the resulting sealed pump chamber is moved axially toward the fluid outlet and is opened there toward the fluid outlet when an opening rotation angle is attained, wherein a screw profile of each of the respective drive spindle and revolving spindle have been chosen in such a manner that a mean value of the number of pump chambers per drive spindle and revolving spindle, which have been sealed both in relation to the fluid inlet and in relation to the fluid outlet, over a rotation angle of the drive spindle of 360° is at most 1.5.

7. The screw pump according to claim 6, wherein the mean circumferential gap between the outer edge of the screw profile of the drive spindle or of at least one of the drive spindles and/or of the revolving spindle or of at least one of the revolving spindles and the housing is less than 0.002 times the outside diameter of the respective screw profile.

8. A method for conveying a fluid through a screw pump, wherein at least one drive spindle of the screw pump is driven by an asynchronous motor, wherein the asynchronous motor is operated at a first nominal frequency, a gas/liquid mixture being conveyed as fluid, a measurable variable depending on a liquid content of the fluid is registered, and after a fulfillment of a frequency-change condition depending on the measurable variable, the asynchronous motor is operated at a second nominal frequency, reduced in comparison with the first nominal frequency, wherein the screw pump comprises a housing which forms at least one fluid inlet and one fluid outlet and in which the at least one drive spindle and at least one revolving spindle, rotationally coupled with said drive spindle, of the screw pump are received, which in each rotational position of the drive spindle jointly delimit with the housing several pump chambers, wherein the drive spindle is rotated in a drive direction by the asynchronous motor, as a result of which a respective one of the pump chambers, initially open to the respective fluid inlet, is sealed, the resulting sealed pump chamber is moved axially toward the fluid outlet and is opened there toward the fluid outlet when an opening rotation angle is attained, wherein the drive spindle is driven, at least prior to fulfillment of the frequency-change condition, in such a manner that in the case of a liquid content lying below a limiting value for given pump geometry of the screw pump the pressure in the respective pump chamber prior to and/or upon the opening rotation angle being attained has been increased in comparison with the suction pressure of the screw pump that obtains in the region of the respective fluid inlet by at most 20% or by at most 10% of a differential pressure between the suction pressure and the pressure in the region of the fluid outlet.

9. The method according to claim 8, wherein a screw profile of each of the respective drive spindle and revolving spindle have been chosen in such a manner that a mean value of the number of pump chambers per drive spindle and revolving spindle, which have been sealed both in relation to the fluid inlet and in relation to the fluid outlet, over a rotation angle of the drive spindle of 360° is at most 1.5.

10. The method according to claim 8, wherein the pump geometry of the screw pump being used and the nominal rotational speed at the first nominal frequency have been chosen in such a way that the circumferential speed along the outside diameter of the profile of the drive spindle or of at least one of the drive spindles and/or of the revolving spindle or of at least one of the revolving spindles is at least 15 m/s.

11. The screw pump according to claim 6, wherein the inside diameter of the screw profile of the drive spindle or of at least one of the drive spindles and/or of the revolving spindle or of at least one of the revolving spindles is less than 0.7 times the outside diameter of the respective screw profile.

12. The method according to claim 8, wherein the pump geometry and the nominal rotational speed at the first nominal frequency have been chosen in such a way that the axial speed of the respective pump chamber in the course of the axial motion toward the fluid outlet is at least 4 m/s.

* * * * *